United States Patent [19]

Negley

[11] 3,952,459

[45] Apr. 27, 1976

[54] DRILL GRINDER

[75] Inventor: Marvin C. Negley, Clarinda, Iowa

[73] Assignee: Lisle Corporation, Clarinda, Iowa

[22] Filed: Oct. 29, 1974

[21] Appl. No.: 518,757

[52] U.S. Cl. ..... 51/219 R
[51] Int. Cl.[2] ..... B24B 19/00
[58] Field of Search ..... 51/219 R

[56] References Cited

UNITED STATES PATENTS

| | | | |
|---|---|---|---|
| 2,356,175 | 8/1944 | Olson et al. | 51/219 R |
| 2,564,050 | 8/1951 | Brooks | 51/219 R |
| 2,856,736 | 10/1958 | Eilersgaard | 51/219 R X |
| 2,974,450 | 3/1961 | McVey | 51/219 R |
| 3,359,690 | 12/1967 | McClellan | 51/219 R |
| 3,813,822 | 6/1974 | Grob | 51/219 R X |

*Primary Examiner*—Harold D. Whitehead
*Attorney, Agent, or Firm*—Allegretti, Newitt, Witcoff & McAndrews

[57] ABSTRACT

An improved drill grinder includes a bracket construction for holding a drill against a grinding wheel. The bracket construction includes a number of adjustments for setting the point angle on the drill, the chisel edge angle, the drill size, and the lip clearance angle of the drill.

2 Claims, 8 Drawing Figures

DRILL GRINDER

BACKGROUND OF THE INVENTION

This invention relates to an improved drill grinder and, more particularly, to a drill grinder of compact size and construction which includes a plurality of adjustments that make the grinder capable of sharpening various types, sizes and shapes of drills.

With continued use of a drill; particularly in commercial and manufacturing operations, it is necessary from time to time to sharpen that drill. Heretofore, rather expensive drill sharpening equipment has been provided. Often, such equipment is bulky, complex and expensive. Thus, it is desirable to provide a drill grinder capable of sharpening all types and shapes of drills.

In the past, the assignee of applicant has made a drill grinder which included a grinding wheel driven by an electric motor and a mounting assembly for holding a drill in position for engagement with the grinding wheel to shape the point of the drill. The mounting assembly includes an axial adjustment for setting the point angle of the drill bit. Also included is an adjustment for the size of the drill. Finally, a crude alignment feature for aligning the point of the drill is provided. The alignment feature is a means for arranging the drill in the proper rotational sense relative to the grinding wheel and thereby preserve the chisel edge angle of the drill.

While this prior art structure works quite well, it does not include any mechanism for setting the clearance angle for the point of the drill. The clearance angle is the angle between tangents to the cutting lip or leading edge of a drill and the trailing portion of the cutting lip surface. Preferably, the trailing surface or edge of the cutting lip surface should be somewhat lower than the leading edge. It should, however, not be too much lower since this would cause the cutting edges of the drill bit to break away. Another way of defining the clearance angle is by the radius of curvature of the cutting lip surface. This radius should decrease slightly in back of the leading edge or cutting lip of the drill.

Additionally, the prior art structure does not include any mechanism for maintaining the chisel edge angle for drills of all sizes. The chisel edge angle is the angle between the leading edge or cutting lip of the drill and the line defining the point of a drill.

To overcome these deficiencies in the prior art and simultaneously provide a structure having simplicity of design and ease of operation at low cost, the present invention was conceived.

SUMMARY OF THE INVENTION

In a principal aspect, the present invention relates to an improved drill grinder and, more particularly, to a drill grinder of the type including a grinding wheel having a cylindrical surface in combination with a mounting mechanism for the drill. The mounting mechanism is positioned to hold the point of the drill against the outer cylindrical surface of the grinding wheel. A drill size adjustment is included. The drill size adjustment incorporates a mechanism for setting the clearance angle of the drill. Additionally, the mounting mechanism for the drill includes an alignment device to align the leading edge of the cutting lip of a drill appropriately relative to the grinding surface of the grinding wheel. This alignment feature may be used for drill bits of various sizes and construction.

It is thus an object of the present invention to provide an improved drill grinder construction having means to adjust the clearance angle for the drill as well as the chisel edge angle.

It is a further object of the present invention to provide an improved drill grinder including a cylindrical surfaced grinding wheel in combination with a mounting mechanism for holding the drill in precise position against the grinding wheel.

Another object of the present invention is to provide an improved drill grinder which may be set to accommodate any of a number of sizes of drills.

One further object of the present invention is to provide an improved drill grinder which may be used to sharpen standard two fluted drills, flat bottom drills and core drills having three and four flutes.

These and other objects, advantages and features of the present invention will be set forth in the detailed description which follows.

BRIEF DESCRIPTION OF THE DRAWING

In the detailed description which follows, reference will be made to the drawing comprised of the following Figures.

DESCRIPTION OF THE PREFERRED EMBODIMENT

The drill grinder of the present invention is illustrated in FIGS. 1 through 5. This grinder, as will be described below, is designed to sharpen standard two-fluted drills as well as flat bottom drills and core drills having three or four flutes. This is not a limitation as to the capability of the invention. It is merely a sampling of the capability of the apparatus of the invention.

Figure 6:
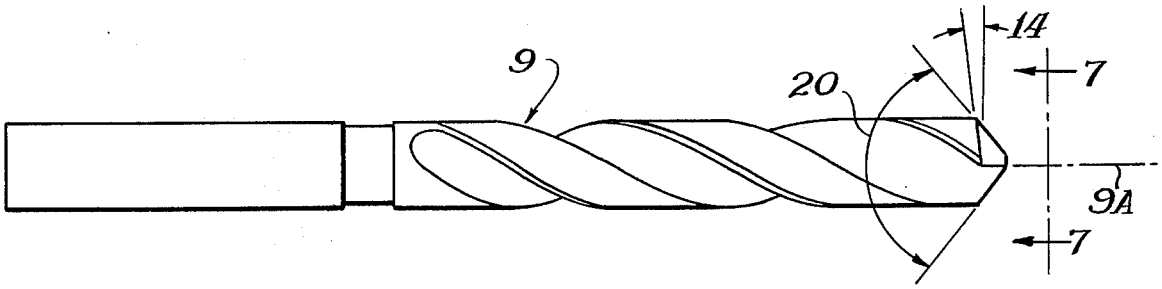
FIG. 6 is a side elevation of a typical drill.
Figure 7:
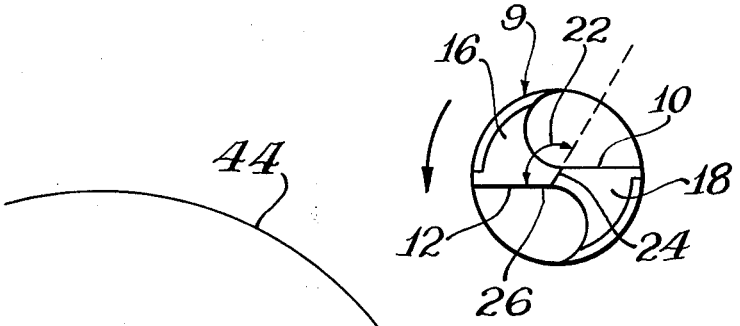
FIG. 7 is an end view of the drill of FIG. 6 taken along the line 7—7.
Figure 8:
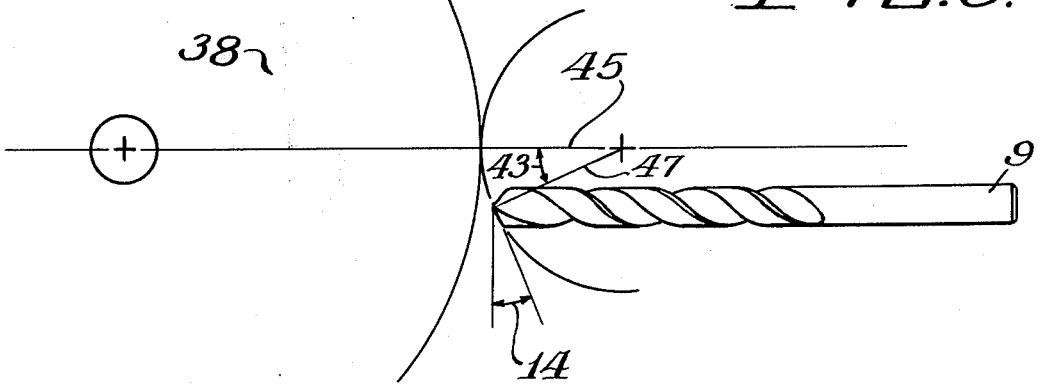
FIG. 8 is a schematic view illustrating the theory of operation of the drill grinder.

FIGS. 6 and 7 illustrate a typical two-fluted drill of the type which may be sharpened by the drill grinder of the present invention. FIG. 8 is a schematic utilized to describe the theory of operation. Before discussing the structure of the present invention, some of the fundamentals of drill sharpening will be reviewed by reference to FIGS. 6, 7 and 8.

A properly sharpened drill 9 is one with sharp cutting edges or lips 10 and 12 in FIG. 7. The lips 10 and 12 are of equal length, and have adequate clearance behind them. This clearance is defined as the lip clearance. The lip clearance angle 14 is illustrated in FIG. 6 and is the angle defined by the tangent to the curved surface 16 at leading edge 12 and the tangent of the trailing edge of that same surface. This angle 14 should be defined so that the cutting lips 10 and 12 will be higher than surfaces 16 and 18 behind those cutting lips. If the surfaces 16 and 18 are higher, then the cutting lips 10 and 12 will not contact the work and the drill will not cut. On the other hand, if the surfaces 16 and 18 result in too great a lip-clearance angle 14, the lips 10 and 12 will cut, but they will tend to break down rapidly.

The drill 9 also includes an included point angle 20 as shown in FIG. 6. A chisel edge angle 22 in FIG. 7 is defined by a leading edge 10 or 12 and the chisel edge 24. Material at the point of the drill intermediate lips 10 and 12 is defined as the web 26. A properly sharpened drill will cut through work material when rotated in the direction of the arrow in FIG. 7.

The improvement of the present invention provides a means for grinding surfaces 16 and 18 in order to maintain a proper included point angle, a proper lip clearance angle, and a proper chisel edge angle. Referring, therefore, to FIGS. 1 through 5 FIG. 1 illustrates in a perspective view the total structure of the present invention.

The drill grinder includes a motor 30 operated by a switch 32. Motor 30 is mounted on a base 34. A lamp 36 is also attached to the base 34.

A grinding wheel 38 having a grinding surface 44 is mounted on shaft 40 of the motor 30. Surface 44 of grinding wheel 38 is a generally cylindrical surface having an axis of rotation coincident with the axis of shaft 40. The grinding wheel 38 is surrounded by a protective housing 42 so that only a portion of grinding surface 44 to the grinding wheel 38 is exposed to perform the drill sharpening operation. A transparent spark protector 46 is attached to the housing 42.

A drill mounting bracket assembly 48 is attached to the base 34 by means of a bracket arm 50. The bracket arm 50 is attached by bolts (not shown) to the base 34 so that the bracket arm 50 may be moved forward or in the reverse direction as indicated by the arrow in FIG. 1 to thereby position the bracket assembly 48 relative to the grinding wheel 38.

Figure 1:
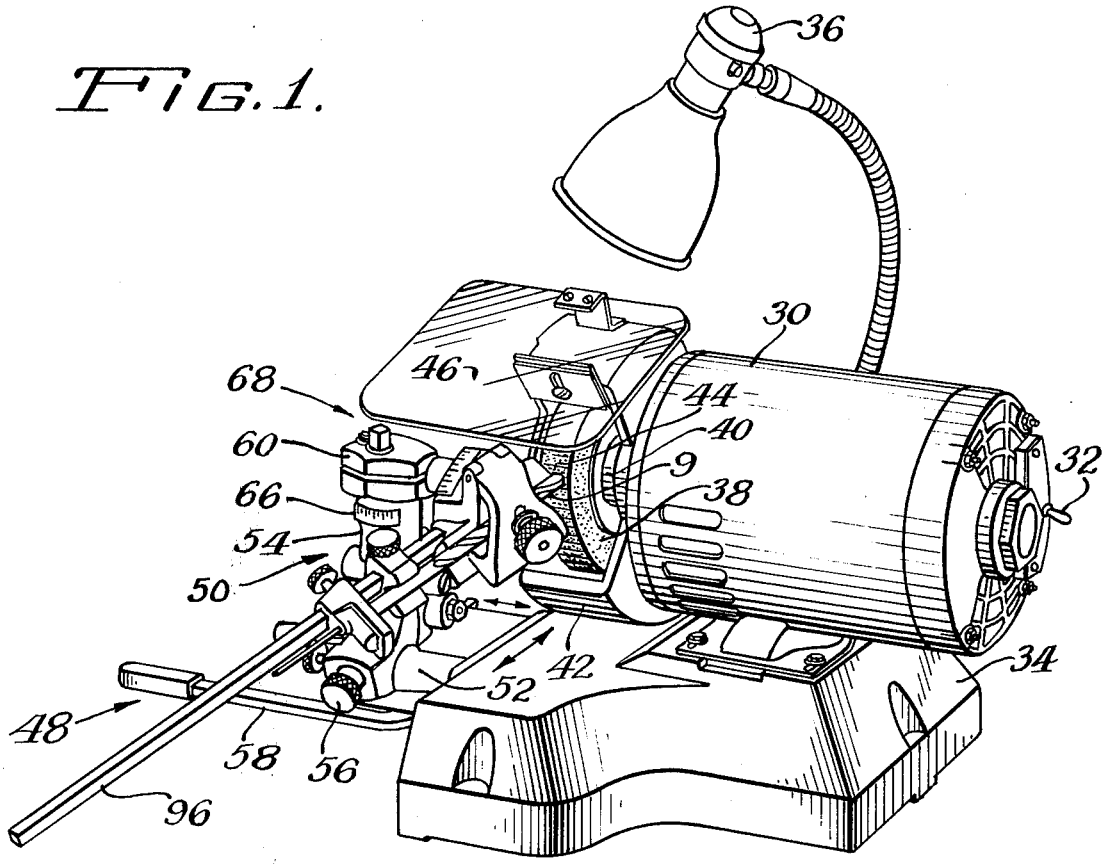
FIG. 1 is a perspective view of the improved drill grinder of the present invention.
Figure 4:
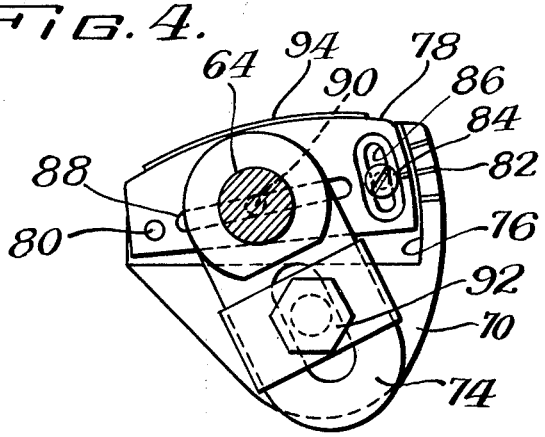
FIG. 4 is a sectional view of the lip clearance adjustment mechanism taken along the line 4—4 in FIG. 2.
Figure 5:
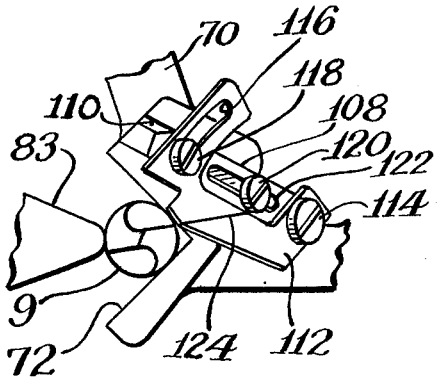
FIG. 5 is an end view of the drill including the chisel edge angle adjustment taken along the line 5—5 in FIG. 2.
Figure 2:
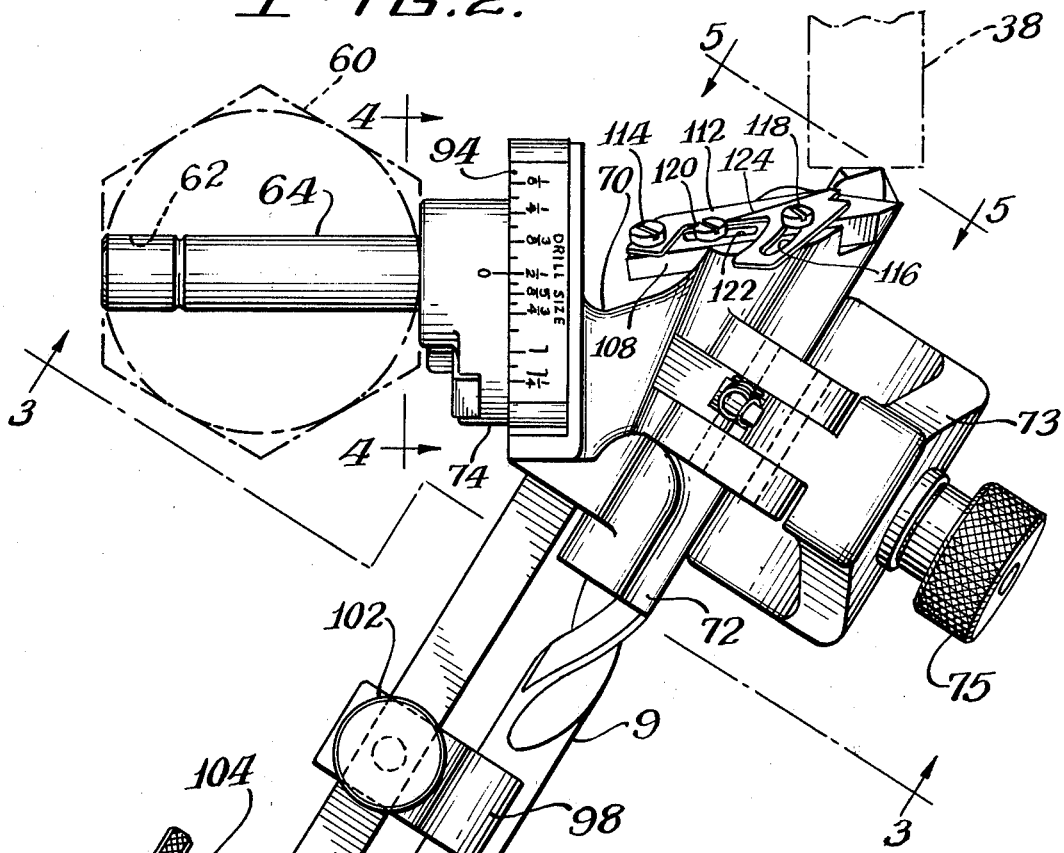
FIG. 2 is a top plan view of the drill holder portion of the drill grinder of the present invention.

A cross feed mechanism is incorporated in the bracket arm 50. The cross feed mechanism includes a cross feed housing 52 having an upstanding bracket 54 mounted therein. Bracket 54 is movable in the direction of the axis of shaft 40 toward and away from the base 34 in response to operation of a cross feed lever 58. Bracket 54 may be rotated about the axis of shaft 40 by a cross feed screw 56. Attached to the cross feed bracket 54 and mounted pivotally therein about a vertical pivot axis is a split bushing 60. As shown in FIG. 2, the split bushing 60 includes a horizontal passage 62 for receipt of a pivot arm 64. The bushing 60 is also pivotal about its vertical axis relative to the bracket 54. An indicator 66 provides a means for indicating the position of the bushing 60 relative to the bracket 54 thereby providing a setting for point angle 20 of the drill 9.

The mechanism so far described is known in the prior art. The structure to be described, namely, the drill clamp assembly, alone and in combination with the prior art structure, constitutes the invention. The drill clamp assembly of the drill grinder provides the additional adjustments claimed and described below.

The drill clamp assembly is illustrated in the enlarged FIG. 2. It includes a clamp bracket 70 having a V trough 72 for receipt of the drill 9. The bracket 70 is attached to the arm 64 through a special pivot construction which is settable to account for proper drill size and proper clearance angle for the drill 9. This structure is illustrated more completely in FIG. 4.

There it is shown that arm 64 is attached to an adjusting flange projection 74. The bracket 70 includes a recess 76 for receipt of a lip clearance adjustment member or block 78. Block 78 is pivotally mounted on bracket 70 by means of a rod 80 projecting from the base of the recess 76. Indicia 82 are provided on the side of the bracket member 70 and block 78 opposite the rod 80 to indicate the relative rotational alignment of the block 78. A set screw 84 extending through a slot 86 is provided to lock the block 78 in a fixed position within the recess 76.

A second slot 88 is defined in the block 78. Second slot 88 cooperates with a projection 90 coaxial with arm 64. Flange 74 is held against the bracket member 70 and projection 90 is held in slot 88 by means of a lock bolt 92. Slot 88 thus defines an axial track in which projection 90 may slide when bolt 92 is loosened. In other words, the block 78 defines the inclined path of the axis of arm 64 as arm 64 is adjusted in the slot 88 when setting the grinder for proper drill size.

The axis of arm 64 is not necessarily parallel to the cylindrical surface of grinding wheel 38 inasmuch as the drill 9 does not necessarily lie in the plane of the grinding wheel 38.

Referring to FIG. 8, a line in the plane of rotation of wheel 38 and extending from the axis of arm 64 to the center of the grinding wheel 38 intersects wheel 38 at the point of contact between the drill 9 and the grinding wheel 38. The distance on this line from the axis of arm 64 to the surface 44 is the radial distance of separation of the pivot axis of arm 64 to the wheel surface 44. This line is defined as the "tangent radius" 45 of the pivot axis.

The drill 9 also includes a longitudinal axis 9A. The angle 43 in the plane of the grinding wheel 38 defined by the tangent radius 45 and a line 47 from the lip of the drill through the axis of arm 64 is equal to the lip clearance angle 14. This angle 43 and thus the clearance angle 14 is adjusted by movement of the block 78, i.e., slot 88.

That is, lock bolt 92 is loosened and the arm 64 is adjusted in slot 88 to the appropriate adjustment indicated on indicator plate 94 for the drill size of drill 9. The inclination of slot 88 is preadjusted to set the clearance angle 14, by precise location of the rod 80 and indicia 82. This locates the slot 88 in such a position that when the projection 90 on arm 64 is moved to adjust for various drill sizes, they are all ground at the same lip clearance angle. The center mark of indicia 82 provides for a clearance angle of approximately 12° which is suggested for average drilling. The top position provides a greater clearance angle and the bottom position gives a lesser clearance angle.

Figure 3:
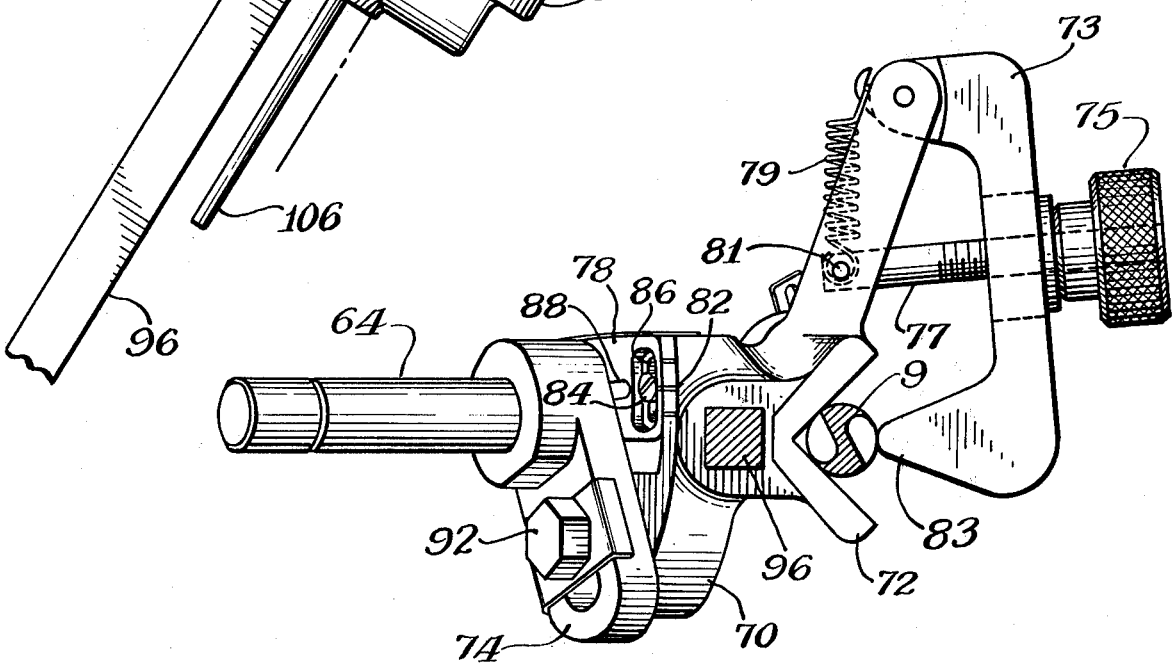
FIG. 3 is a sectional view taken along the line 3—3 in FIG. 2.

The drill 9 is held in the V trough 72 by a clamp 73. Clamp 73 is positioned against the drill 9 by clamp knob 75 threadably attached to a clamp rod 77 extending from the bracket 70. A spring 79 in FIG. 3 extends between pin 81 in bracket 70 and the end of clamp 73 to bias the clamp 73 out of engagement with the drill 9. The clamp 73 includes a projecting end 83 which securely grips the drill 9 and holds it in size. trough 72 when the knob 75 is tightened on the dowel or rod 77. This is illustrated in FIG. 3.

Extending rearwardly from the bracket 70 is a drive bar 96. The bar or holder rod 96 has a square cross section. Mounted thereon is a V support block 98 and an end stop block 100. Both of these blocks include threaded bolt attachments 102 and 104, respectively, to permit adjustment of the support block 98 and end stop block 100 to accommodate drills of varying size, A projecting rod 106 is provided on end stop block 100. Rod 106 is used as an end stop for small drills which do not extend beyond the V trough 72. Thus, the end stop block 100 is reversible from the position shown in FIG. 2. This combination of elements holds the drill 9 tightly in position against the grinding wheel 38.

However, the drill 9 must be properly oriented or rotated about axis 9A within the V trough 72 so that a lip 10 or 12 will be evenly and uniformly engaged by the grinding wheel 38. Proper positioning of the drill 9 insures that the chisel edge angle will be maintained. This is accomplished by rotating the drill 9 to a proper position within the trough 72 and then clamping the drill 9. Orientation of the drill 9 in a rotational sense about its longitudinal axis 9A is accomplished by means of a chisel edge angle adjustment assembly illustrated in FIG. 5.

The chisel edge angle adjustment assembly includes a chisel edge angle adjustment stop block 108 slidably mounted in a trough or slot 110. A chisel edge angle adjustment stop 112 is rotatably mounted on the block 108. Stop 112 is thus pivotal on and about bolt 114. The amount of rotation permissible about the axis of bolt 114 is determined by slot 116 in the opposite end of the stop 112. A screw 118 is provided through slot 116 engaging block 108 to fix the stop 112 in a desired rotational position. Screw 120 extending through slot 122 in block 108 permits sliding movement of the block 108 in trough 110 and fastening of that block 108 in a desired fixed position.

Importantly, a straight line indicia 124 is scribed on the stop 112. The indicia 124 is defined so that the lip 10 or 12 of drill 9 may be aligned with indicia 124. This alignment determines the proper drill rotation in regard to the surface 44 of the grinding wheel and insures that the proper chisel edge angle will be obtained. This chisel edge angle is maintained for drills of all helix angles. The stop 112 is then positioned in contact with the margin of drill 9 by appropriate loosening of screws 120 and 118 and movements of block 108 and stop 112. After lip 10 is ground, the drill is rotated 180° against the stop 112 thus positioning the lip 12 in the exact position as lip 10 when it was ground.

In operation of the drill grinder, the first step is to set the desired point angle using bushing 60 and bracket 54 in combination with indicia 66. Next, the clearance angle is set by adjusting set screw 84 and block 78. Subsequent to that, the drill size is set on indicia plate 94 by adjusting lock bolt 92 and arm 64. The drill 9 is then inserted in the V block 72. The drill 9 is pushed to the end of the V trough and drill rotation is set by aligning indicia 124, when stop 112 is in the extreme right position, with lip 10 or 12. The drill 9 is then tightened in the V trough 72 by knob 75 and the stop 112 is moved against the margin of the drill 9 and tightened in place.

To sharpen the drill 9, the grinder wheel 38 is set in operation by the motor 30. The bar 96 is then manually moved up and down as the feed screw 56 or cross feed lever 58 is operated to drive the drill 9 across the face 44 of the grinding wheel 38. Moving the bar 96 up and down causes the surface 16 or 18 to be in contact with the surface 44 thereby grinding and sharpening the drill point. After one lip of the drill 9 is shaped, the drill is rotated to align the other lip.

While in the foregoing there has been set forth a preferred embodiment of the present invention, it is to be understood that the invention shall be limited only by the following claims and their equivalents.

What is claimed is:

1. In a drill grinder apparatus of the type including a support adjacent a grinding wheel, an arm pivoted to said support and thereby providing an axis of oscillation for a drill holder, a drill holder having a slot to receive said arm whereby said axis of oscillation, in all positions of the arm relative to the slot, passes through the slot, a slotted flange extending laterally from said shank, a clamp screw carried by said drill holder and coacting with the slot of said flange to retain the flange in any position of adjustment of said arm relative to said slot in said drill holder, the axis of a drill when in said holder being at an angle to the axis of said slot whereby said drill axis is variable by shifting said arm along said slot to increase the distance from the cutting end of the drill to said axis of oscillation whereby to increase the radius of the arc on which the cutting lip of a larger drill is ground as a result of swinging of said drill holder on said axis of oscillation, the improvement comprising means for adjusting and setting the angle of inclination of the slot defined in the drill holder thereby to adjust the lip clearance angle of the drill, said means for adjusting including a block defining said slot, said block being pivotally attached to said drill holder and including fastening means for retaining said block in a fixed pivotal position.

2. The improvement of claim 1 also including means on the holder for setting the chisel edge angle comprising a trough for the drill, an indicator mounted at the end of the trough on the holder adjacent the grinding wheel, said indicator and a lip of said drill defining a straight line cutting edge of the drill, the line of said indicator being adjustable by movement thereof both toward the drill and transverse to the drill.

* * * * *